US009593451B2

(12) United States Patent
House et al.

(10) Patent No.: US 9,593,451 B2
(45) Date of Patent: Mar. 14, 2017

(54) MOVABLE FOIL BLADE FOR PAPERMAKING ON A FOURDRINIER, INCLUDING THE LEAD BLADE ON THE FORMING BOARD BOX

(71) Applicants: Richard L House, Lewiston, ID (US); Warren E Hills, Jr., Clarkston, WA (US)

(72) Inventors: Richard L House, Lewiston, ID (US); Warren E Hills, Jr., Clarkston, WA (US)

( * ) Notice: Subject to any disclaimer, the term of this patent is extended or adjusted under 35 U.S.C. 154(b) by 43 days.

(21) Appl. No.: 14/732,679

(22) Filed: Jun. 6, 2015

(65) Prior Publication Data

US 2016/0130754 A1 May 12, 2016

Related U.S. Application Data

(60) Provisional application No. 62/123,141, filed on Nov. 10, 2014.

(51) Int. Cl.
*D21F 1/10* (2006.01)
*D21F 1/48* (2006.01)

(52) U.S. Cl.
CPC ..... *D21F 1/486* (2013.01)

(58) Field of Classification Search
CPC . D21F 1/483; D21F 1/486; D21F 1/10; D21F 9/00
USPC ..... 162/352
See application file for complete search history.

(56) References Cited

U.S. PATENT DOCUMENTS 4,278,497 A * 7/1981 Mellen ..... D21F 1/523 15/309.1
4,280,869 A * 7/1981 Eckerdt ..... D21F 1/523 15/309.1
4,459,176 A * 7/1984 Goodnow ..... D21F 1/523 162/366
4,684,441 A * 8/1987 Ibrahim ..... D21F 1/00 162/198
4,718,983 A * 1/1988 Ibrahim ..... D21F 1/00 162/252
5,421,961 A * 6/1995 Miller ..... D21G 9/0027 162/252
5,830,322 A * 11/1998 Cabrera y Lopez Caram ..... D21F 1/483 162/209
5,922,173 A * 7/1999 Neun ..... D21F 1/20 162/351
6,372,093 B1 * 4/2002 Brewer ..... D21F 1/486 162/352
6,471,829 B2 * 10/2002 Frawley, Jr. ..... D21F 1/483 162/208
6,712,941 B2 * 3/2004 Sherril ..... D21F 1/00 162/208
RE43,679 E * 9/2012 Van Essen ..... 162/352
8,747,618 B2 * 6/2014 Cabrera y Lopez Caram ..... D21F 1/48 162/202

* cited by examiner

*Primary Examiner* — Mark Halpern

(57) ABSTRACT

A method for operably adjusting a forming board lead blade of a paper sheet forming machine of the type having a headbox for impinging a jet of slurry from a slice opening of the headbox onto the surface of a porous wire moving continuously in a horizontal machine direction over the forming board.

4 Claims, 14 Drawing Sheets

MOVABLE FOIL BLADE FOR PAPERMAKING ON A FOURDRINIER, INCLUDING THE LEAD BLADE ON THE FORMING BOARD BOX

CROSS-REFERENCE TO RELATED APPLICATIONS

U.S. Pat. Nos.; Ibrahim U.S. Pat. No. 4,684,441, issued Aug. 4, 1987, Ibrahim U.S. Pat. No. 4,718,983, issued Jan. 12, 1988, Miller U.S. Pat. No. 5,421,961, issued Jun. 6, 1995, Mellen U.S. Pat. No. 4,278,497, issued Jul. 14, 1981, and Mellen U.S. Pat. No. 4,280,869, issued Jul. 28, 1981.

TECHNICAL FIELD

This invention relates to continuous paper sheet forming machines having a Fourdrinier table and more particularly relates to improvements in the forming board of such machines which result in good formation, retention and control of sheet properties.

BACKGROUND

Prior Art

FIG. 1 shows a typical papermaking machine with a Fourdrinier table 37 and the first part of the sheet forming process. This process is typically characterized by the provision of a headbox 21 for directing a jet 23 of papermaking slurry 22, exiting out of the slice opening of the headbox 21 and impinging on the upper surface of the Fourdrinier table 37 just downstream from the breast roll 27. Typically a Fourdrinier papermaking machine has a front or tending side and a back or drive side. The tending side is where a wire 26 is pulled off of the Fourdrinier Table 37 when the wire 26 is damaged or worn. The back side of the Fourdrinier is typically where rolls in the fourdrinier are driven. The papermaking slurry 22 is mostly water with solids content or percent consistency of about 1% fiber, fines and fillers. The content of the solids in the water is measured in percent consistency. All of the rolls and table elements of the Fourdrinier Table 37 are supported with cantilever beams such that the wire 26 can be removed like a sock toward the tending side of the machine.

The percent consistency on the Fourdrinier table 37 is in the range of from less than 1% at the Headbox 21 to 25% at the end of the Fourdrinier table 37 as water is drained from the slurry 22 along the length of the Fourdrinier. The Fourdrinier table 37 consists of a porous wire mesh or wire 26 moving continuously in the horizontal machine direction 33 on a set of rollers and Fourdrinier table elements that will allow the water to drain through the upper surface of the wire 26 leaving the paper fibers in the slurry 22 to settle on the wire 26 and be removed at the end of the Fourdrinier table 37 at a roller called the Couch Roll not shown in FIG. 1. The fiber slurry 22 comes off the Couch Roll as a wet sheet of paper in a continuous unending way as the wire 26 moves back toward the breast roll 27 over wire return rollers 27*a*. Two of the Fourdrinier table elements that support the wire 26 are shown in FIG. 1, a forming board 30 and a first gravity drainage box 35. These Fourdrinier table elements facilitate draining of the water through a wire 26 as the slurry 22 progresses along the length of the Fourdrinier 37 resulting in higher solids content or percent consistency in the slurry 22. The table elements 30 and 35 consist of drainage boxes with a plurality of foil blades that scrape or doctor the water off of the underside of the wire 26 and create pressure pulsations in the slurry 22 above the wire 26 which help keep the fibers in the slurry 22 distributed evenly in the resultant sheet allowing for better sheet quality and strength characteristics. The first of these drainage elements is called the Forming Board 30 which consists of a plurality of foil blades. The first foil of the forming board 30 or lead blade 29 supporting the wire 26 is where a jet flow of the slurry, called the jet 23, lands or impinges on the wire 26.

Typically the foil blades are mounted on a T-bar assembly, which is familiar to one experienced in the art. The foil blades have a matching groove that fit over the T-bar and provide for sliding the foil blades off of the T-bar on the tending side to replace the blade due to the frictional wear from the wire 26. Often times this can be done when the machine is in operation. An example of this is in FIG. 2 where a foil blade called the Follower blade 43 fits over a T-bar 54.

The forming board 30 and particularly the lead blade 29 provide a support surface immediately downstream of the headbox 21, beneath the wire 26 to gently retain the water in the slurry 22. The lead blade 29 allows an initial fiber mat to be created on the wire 26 which aids in the retention of fibers, fines and fillers as water is removed down the Fourdrinier table 37. The lead blade 29 is made of composite materials with the exposed surface to the wire 26 made of a hard ceramic cover 9*b* shown in FIG. 5*a* to resist wear with the moving wire 26 over the forming board 30. The core of the lead blade 29 is usually a composite material such as fiberglass and provides for a surface to adhere the ceramic material forming a continuous blade that is equal in length to the width of the Fourdrinier Table 37.

The correct landing of the jet 23 onto the wire 26 is essential to good formation, retention, and control of sheet properties. This is published in trade journals one of which is referenced (The Institute of Paper Chemistry "IPC" Technical Paper #206 "Fourdrinier Jet Geometry"). The referenced paper states that the location of the forming board 30 is especially critical as shown in FIG. 2 where the leading edge of the forming board lead blade 29 should split the jet 23 in a particular manner so that any "jump" or "bounce" on the Forming Board 30 is eliminated. This particular manor of the split of the jet 23 will result in a downward jet 28 causing a momentum change in the remaining part of slurry 22 to travel with the wire 26 horizontally in the machine direction 33.

The top and bottom slice lips (4 & 5) of the headbox 21 serve to regulate the size and shape of the jet 23. This is affected by the I/b ratio where I in FIG. 2 is the distance the bottom slice Lip 25 extends over the top slice lip 24 and b is the opening height of the top lip 24 above the bottom lip 25 which extends across the full width of the headbox 21. The opening of the slice determines the flow rate of the slurry 22 out of the headbox 21. Additionally, the pressure inside the headbox 21 provides the initial velocity out of the jet 23 emerging out of the slice opening of the headbox 21 to allow for the speed of the jet 23 to impinge on the wire 26 at the correct velocity in relation to the speed of the wire 26. The velocity of the jet 23 can be faster than the wire 26, as in the case of velocity forming, the same speed of the wire 26 or slower than the wire 26 such as in the case of pressure forming depending on the grade of paper being produced. For this reason the location of impingement of the jet 23 on the wire 26 and the downward direction 32 of the jet 23 (which can be controlled by the I/b ratio) impinging on the wire 26 from the headbox 21 will be different for each grade of paper being produced. Generally the profile and the location of impingement on the wire 26 can be calculated based on the influence of gravity and the basic laws of hydraulics for which is commonly treated in technical literature. However the ideal location of the forming board 30 can depend on many factors other than jet and wire velocity such as air entrapment, the shape of the leading edge of the lead blade 29, including but not limited to the angle "Y" shown in FIG. 5*a*, and sheet properties that are to be obtained. Hence, the art of papermaking and the ideal position of the forming board 30 being dependent on the choices made by the operator.

Unfortunately most machines do not provide for the headbox 21 to move to allow for the jet 23 to impinge on the wire 26 in the same place or at the same direction 32 as shown in FIG. 2 for all grades. For this reason prior art has concentrated on moving the forming Board 30 as does this invention.

Prior art in U.S. Pat. Nos.; Ibrahim U.S. Pat. No. 4,684,441, issued Aug. 4, 1987, Ibrahim U.S. Pat. No. 4,718,983, issued Jan. 12, 1988, and Miller U.S. Pat. No. 5,421,961, issued Jun. 6, 1995 provide for the movement of the forming board in the machine direction toward the headbox or away from the headbox. This invention is an improvement on the above described prior art by only moving the lead blade and not the whole forming board assembly as described in the aforementioned Patents.

Additionally, this invention is not concerned with the trailing edge of the lead blade for which the Ibrahim Patent describes because if the leading edge of the lead Blade 29 is properly located to split the jet 23 as shown in FIG. 2 such that the horizontal momentum of the slurry 22 would reduce the impact of where the trailing edge of the lead blade 29 is located. In FIG. 2 the jet 23 impinges at the leading edge of the lead blade 29 in the direction of 32. The velocity of the slurry 22 should be purely horizontal in direction 33 with a thickness of t2 and the downward pointing jet 28 in direction 31 with a thickness of t3 such that t=t2+t3. The ratio t3/t2 should be in the range of 5% to 10% to provide for the ideal momentum transfer depending on several factors including the shape of the leading edge of the Lead Blade 29 including the angle "Y" shown in FIG. 5*a*.

Another improvement of prior art is the simplicity of how the lead blade 29 is moved in the machine direction 33*a*, toward or 33*b*, away from the headbox 21 shown in FIGS. 3 and 3*a*. This invention includes a simple angular slide arrangement similar to prior art in U.S. Pat. Nos.; Mellen U.S. Pat. No. 4,278,497, issued Jul. 14, 1981 and Mellen U.S. Pat. No. 4,280,869, issued Jul. 28, 1981 that can be actuated outside of the width of the Fourdrinier table 37 using a jack screw actuator 36 to move the Lead Blade 29. FIGS. 10, 10*a*, and 11 show another embodiment of the invention whereby the lead blade 29 is moved along the angular slides by a plurality of servo gear-motor drives 68 with a rack and pinion design. The novel concept of the angular slide in this invention will be more fully realized and understood from the following detailed description when taken with the accompanying drawings. The simplicity of these designs eliminates the need for cylinders, jack screws and cross machine shafts as shown in prior art of U.S. Pat. Nos. 4,684,441, 4,718,983, and 5,421,961 that would be installed across the width of the Fourdrinier table with more exposed to the drainage of the slurry under the wire and which are more unreliable and increase the cost of manufacture of the Forming Board.

This invention is an improvement in the angular slide arrangement as mentioned above in U.S. Pat. No. 4,278,497 in that the wear strip or blade that slides back and forth along a single T-bar the full width of the machine has too shallow of an oblique angle requiring a much too long blade to move along the cross machine direction to allow the required movement of the blade in the machine direction. By having a plurality of grooves across the full width of the blade, not shown in prior art, this invention allows for a steeper angle resulting in a shorter blade and more movement of the blade in the machine direction. This is of course at the expense of increased loading on the actuator that moves the blade. Additionally, the actuator providing the force in prior art is not pulling in the same direction as the oblique angle of the slide requiring additional linkage and pin connections to move the blade at additional cost to manufacture the equipment. The novelty of the arrangement of the grooves and T-bars for which the blade slides on in this invention is illustrated in FIGS. 3 and 3*a* where the oblique angle "X" is large enough to allow for the required movement of the blade in the direction 33*b* in FIG. 3*a* or the direction 33*b* in FIG. 3 and provide for a blade that is not so long and impractical to be installed in the machine. This is accomplished by having a plurality of grooves spaced parallel to each other across the full length of the blade shown in the hidden lines of the FIGS. 3 and 3*a*. The placement of the grooves 45 and the guide bars 46 are more graphically shown in FIG. 10 and as the oblique hidden lines in the embodiment of the forming board 30 in FIG. 1. In this way the blade is supported across the full width of the machine and will slide uniformly across the full width of the machine by pulling or pushing on one end of the blade.

This invention is an improvement in the angular slide arrangement as mentioned above in U.S. Pat. No. 4,280,869 in that cam followers in the slides of the blade that are not in this invention are additional complexity to the system and have much higher loads for moving the blade in the Machine direction 33 of FIG. 1 which would be much more unreliable than the slide system of this invention. Additionally, the novel concepts of the roller assemblies in the slide base 38 as shown in FIG. 7 and FIG. 8 are to reduce the load of the jack screw actuator 36 and will be more fully realized and understood from the following detailed description when taken with the accompanying drawings.

This invention is also an improvement in Prior art because the forming board does not move with respect to the other drainage elements and foil blades on the Fourdrinier table thereby not impacting any changes to the harmonics of the papermaking process with changes in spacing between foil blades of the forming board and the foil blades of the next drainage box downstream.

SUMMARY

In accordance with the embodiment in FIG. 3 and FIG. 3*a* it is the object of this invention to move the leading edge of the Forming Board to the proper location as shown in FIG. 2 such that the impingement of the jet from the slice opening of the headbox is split to provide for good formation, retention, and control of sheet properties resulting in improved sheet quality.

It is another objective of this invention as shown in the embodiment of FIG. 4 that only the led blade of the forming board moves such that the spacing between foils downstream of the follower blade 43 is unchanged thereby not impacting any changes to the harmonics of the papermaking process with changes in spacing between foil blades of the Forming Board and the next foils of the Drainage box downstream.

Another objective of this invention as shown in the embodiment of FIG. 7 and FIG. 8 is to provide for rolling surfaces in the slide base 38 resulting in reduced loading on the jack screw actuator 36 for moving the lead blade back and forth along the plurality of guide bars 46.

Another objective of this invention as shown in the embodiment of FIG. 4 is to provide for moving the lead blade while the papermaking process is running. The jack screw actuator 36 can be connected to an electric motor in place of the hand wheel 39 to effect movement of the lead blade 29 remotely. Additionally, the lead blade can be moved remotely as shown in the embodiment of FIGS. 10, 10*a*, and 11, by a plurality of servo gear-motor drives 68 that have brakes and load sharing capacity to position the lead blade 29 per the operator's discretion. A linear sensor can be attached to the lead blade 29 as feedback to any electric motor or servo motor system to limit the movement of the lead blade 29 from causing any damage to the equipment.

The novel concepts of the present invention will be more fully realized and understood from the following detailed description when taken with the accompanying drawings. In addition, other modifications and variations may be effected without departing from the spirit and scope of the novel concepts of the disclosure.

DRAWINGS

Figures

Figure 3:
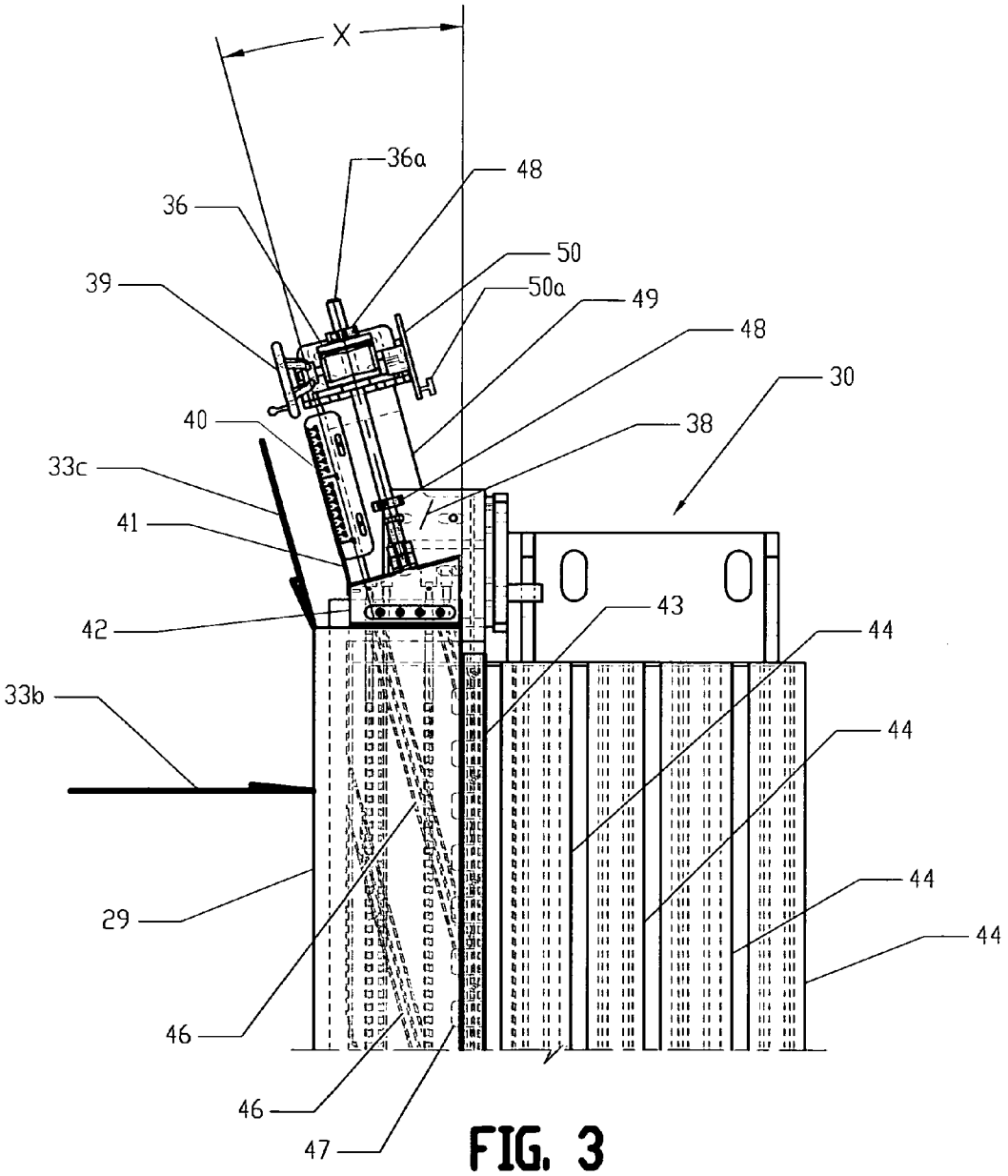
FIG. 3 is fragmentary top view of the forming board 30 at the actuator end showing the lead blade 29 in the retracted position.
Figure 3A:
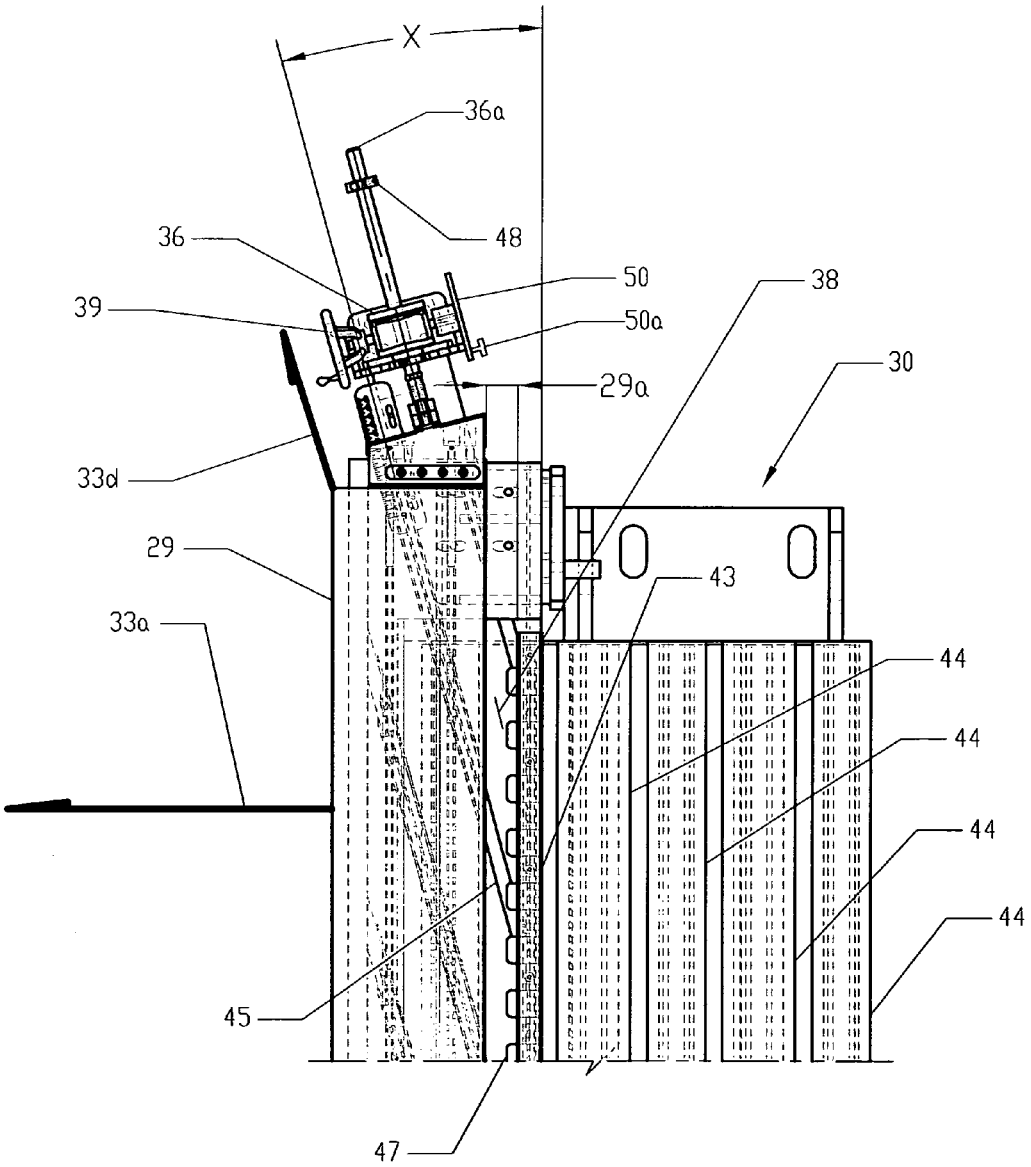

FIG. 3*a* is fragmentary top view of the forming board 30 at the actuator end showing the lead blade 29 in the extended position.

Figure 4:
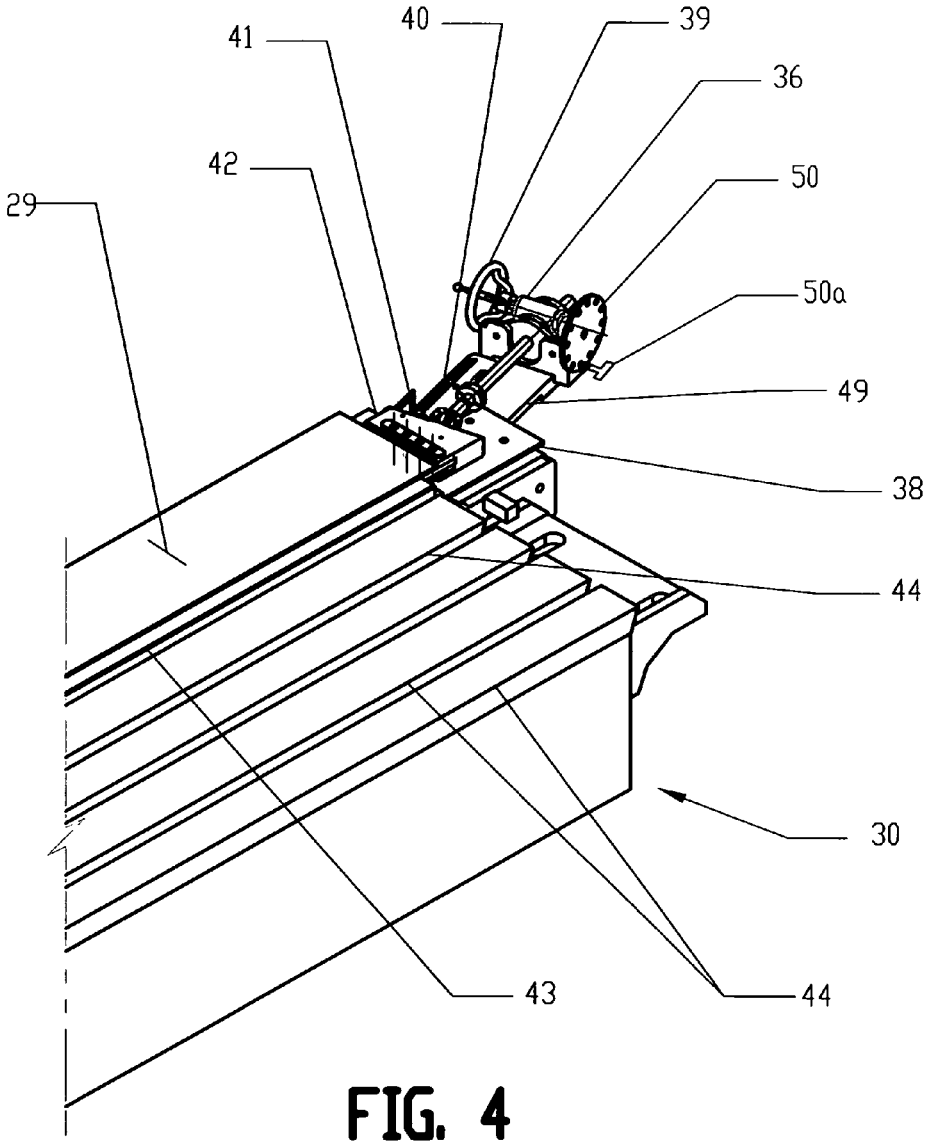

FIG. 4 is a perspective view of the forming board 30 at the actuator end showing the lead blade 29 in the retracted position.

Figure 5A:
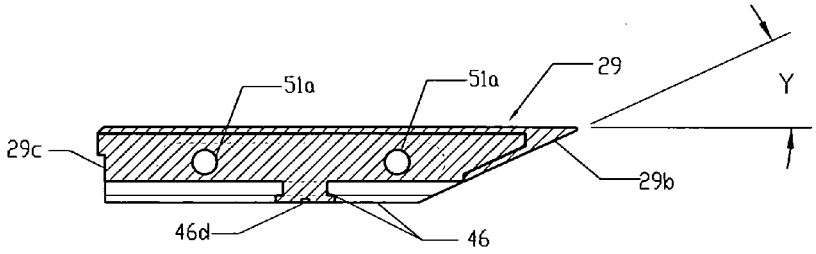
Figure 5:
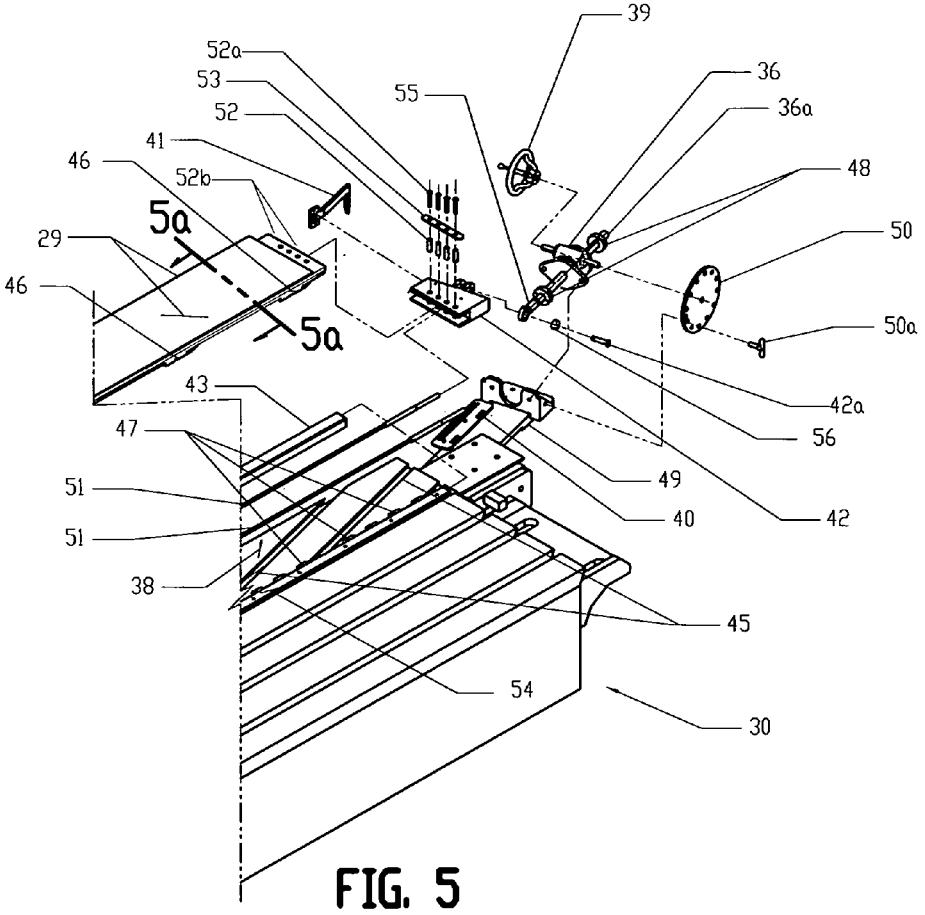

FIG. 5 is an exploded view of the forming board at the actuator end.

FIG. 5*a* is a sectional view of the lead blade taken along the line 5*a*-5*a* of FIG. 5.

Figure 6A:
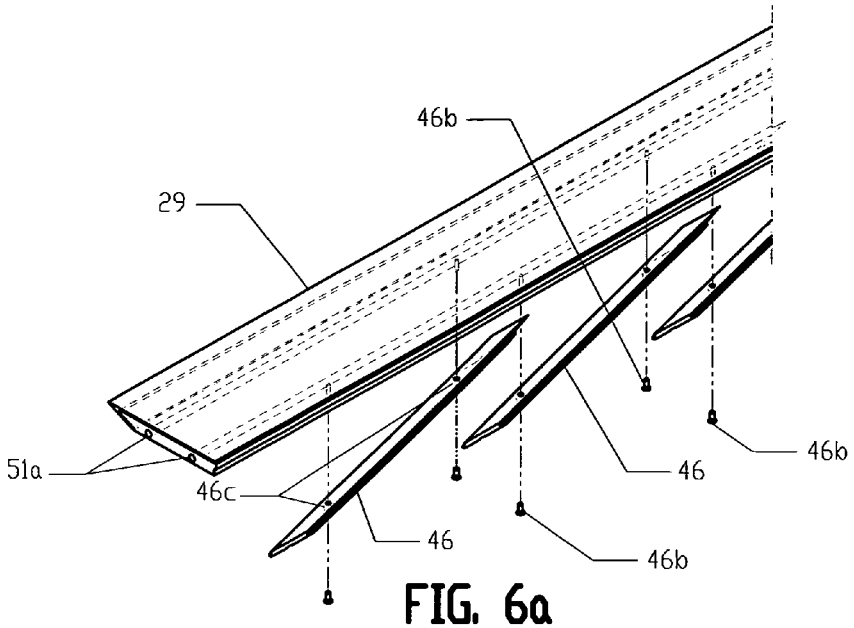
Figure 6:
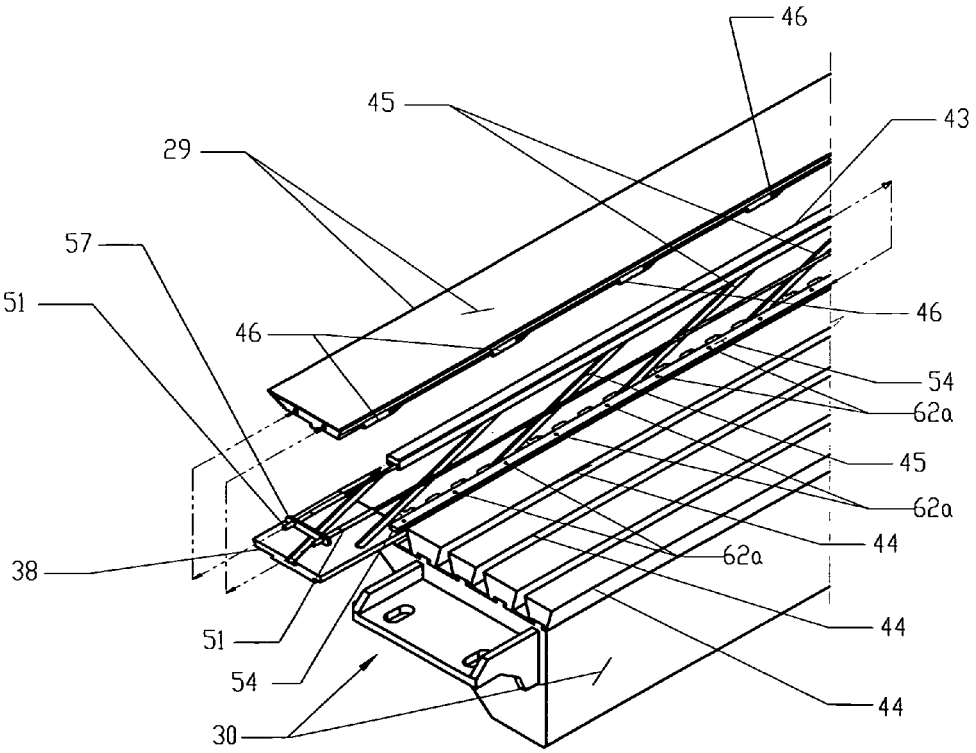

FIG. 6 is an exploded view of the forming board at the non-actuator end.

FIG. 6*a* is an exploded view of one end of the lead blade.

Figure 7:
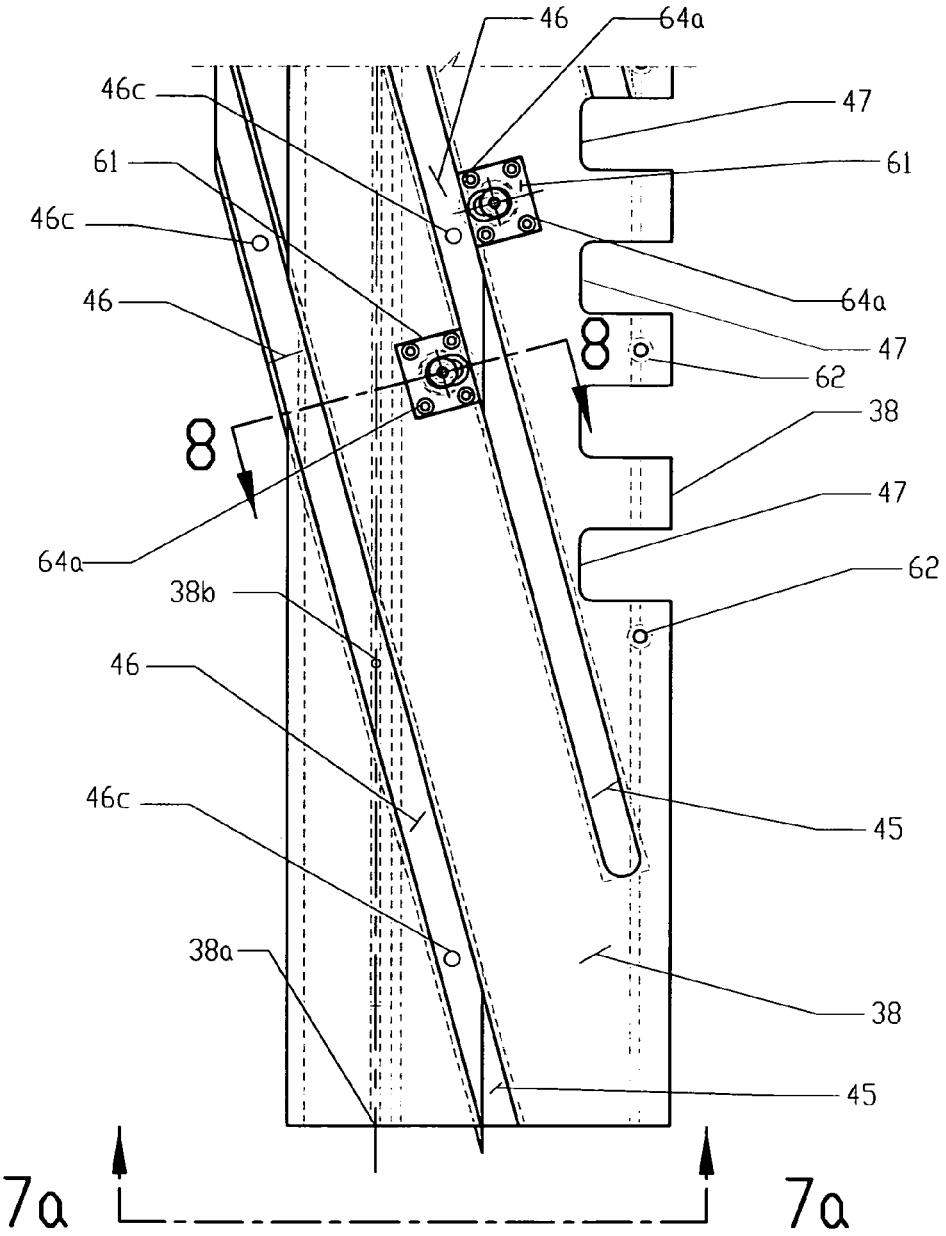

FIG. 7 is a fragmentary plan view of the slide base showing the addition of rollers mounted adjacent to the grooves of the slide base.

Figure 7A:
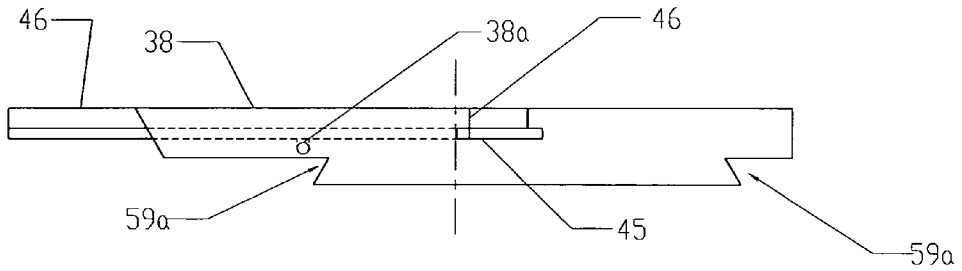

FIG. 7*a* is a sectional view of the slide base taken along the line 7*a*-7*a* of FIG. 7.

Figure 8:
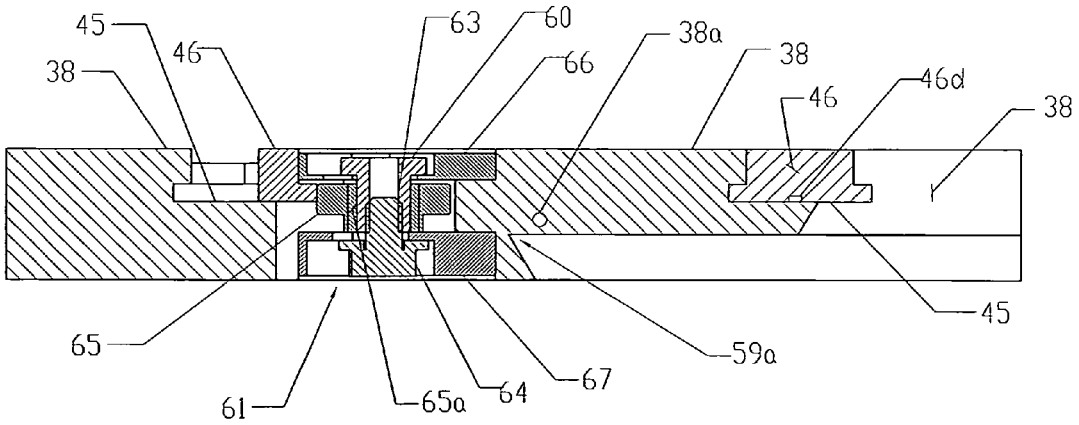

FIG. 8 is a sectional view taken along the line 8-8 of FIG. 7.

Figure 9:
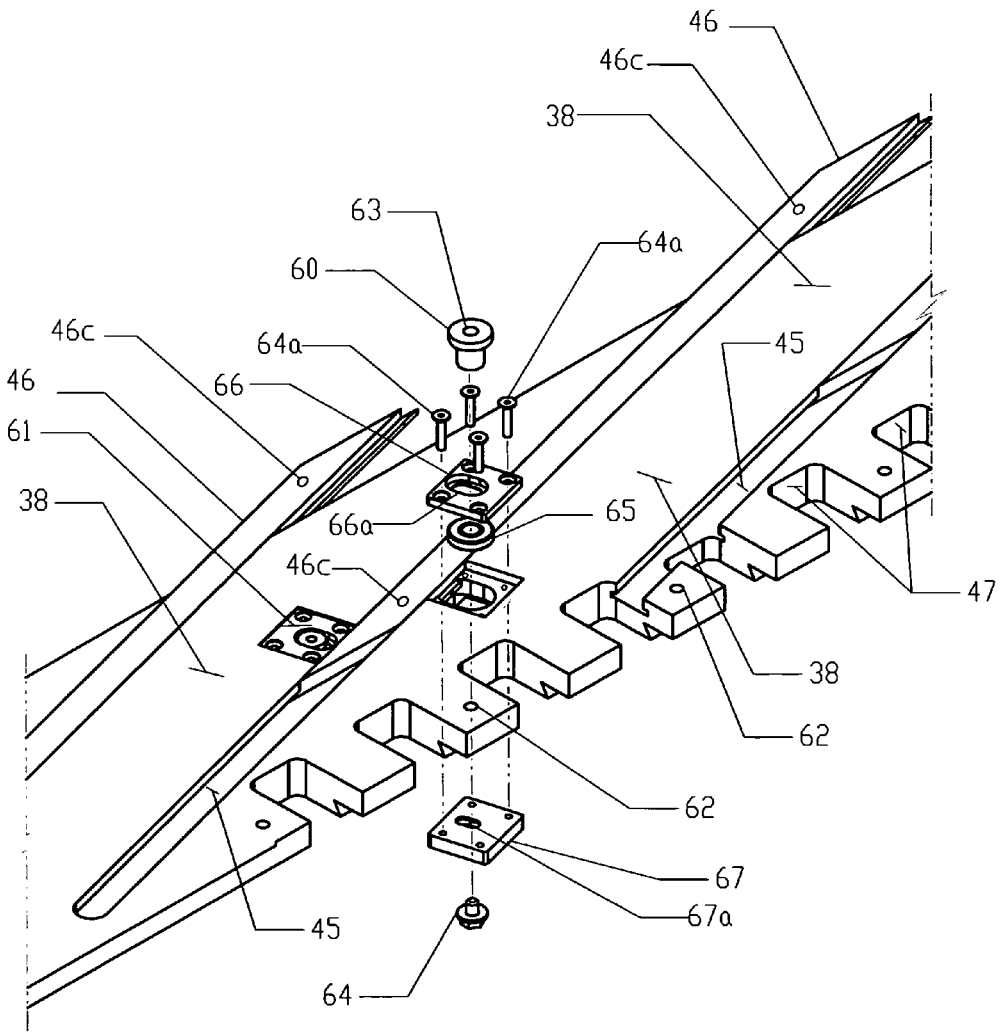

FIG. 9 is an exploded view of the roller assembly in the slide base.

Figure 9B:
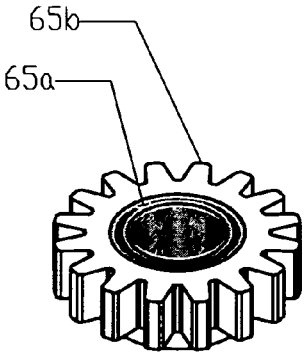
Figure 9C:
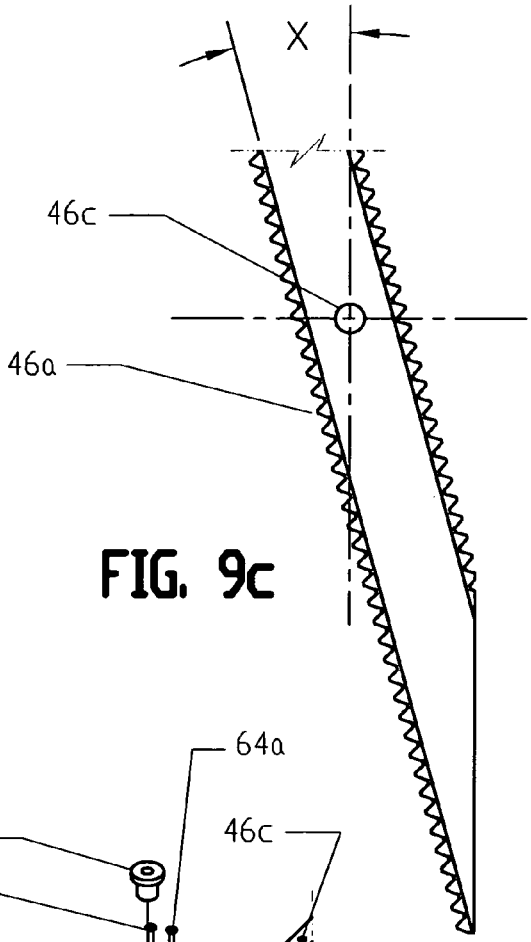
Figure 9A:
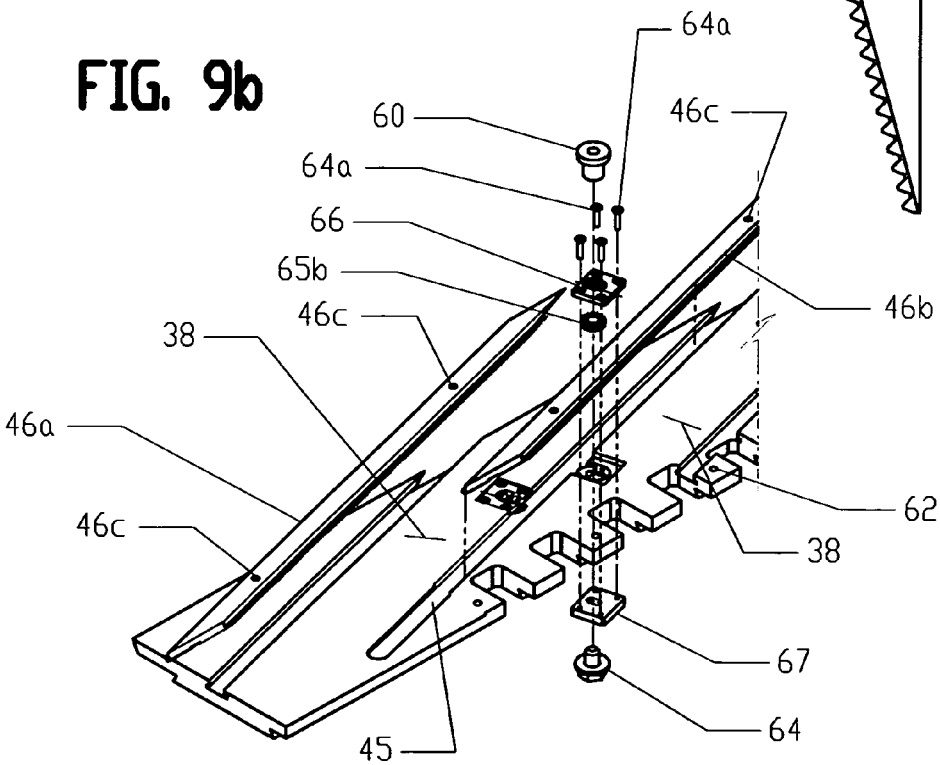

FIG. 9*a* is an exploded view of a rack and pinion assembly in the slide base.

FIG. 9*b* is a perspective view of the pinion with roller bearing.

FIG. 9*c* is a partial view of the guide bar 46*a*.

Figure 10:
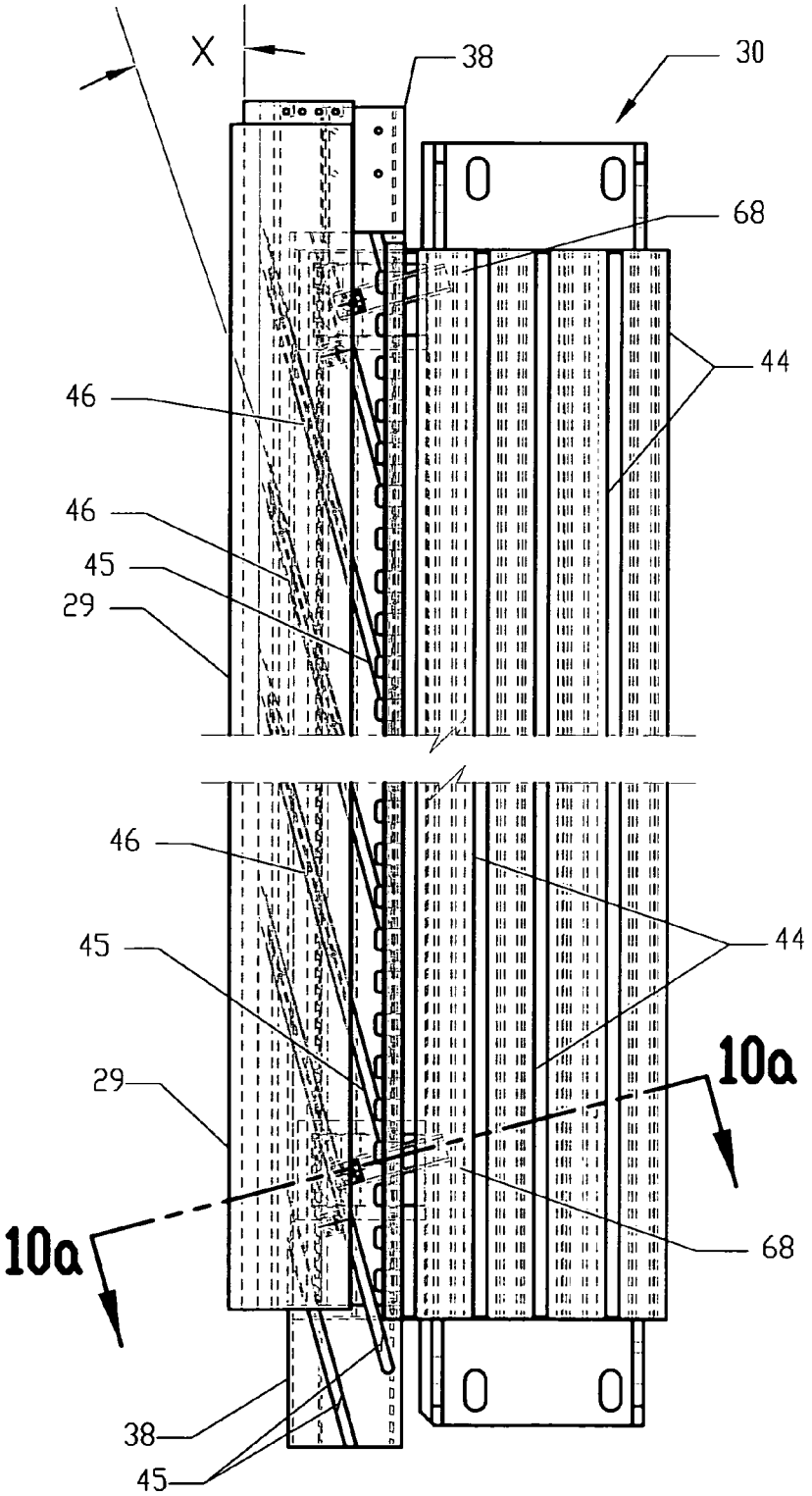

FIG. 10 is a partial view of an alternative embodiment of the invention for moving the lead blade 29 using a plurality of servo gear-motors 68.

Figure 10A:
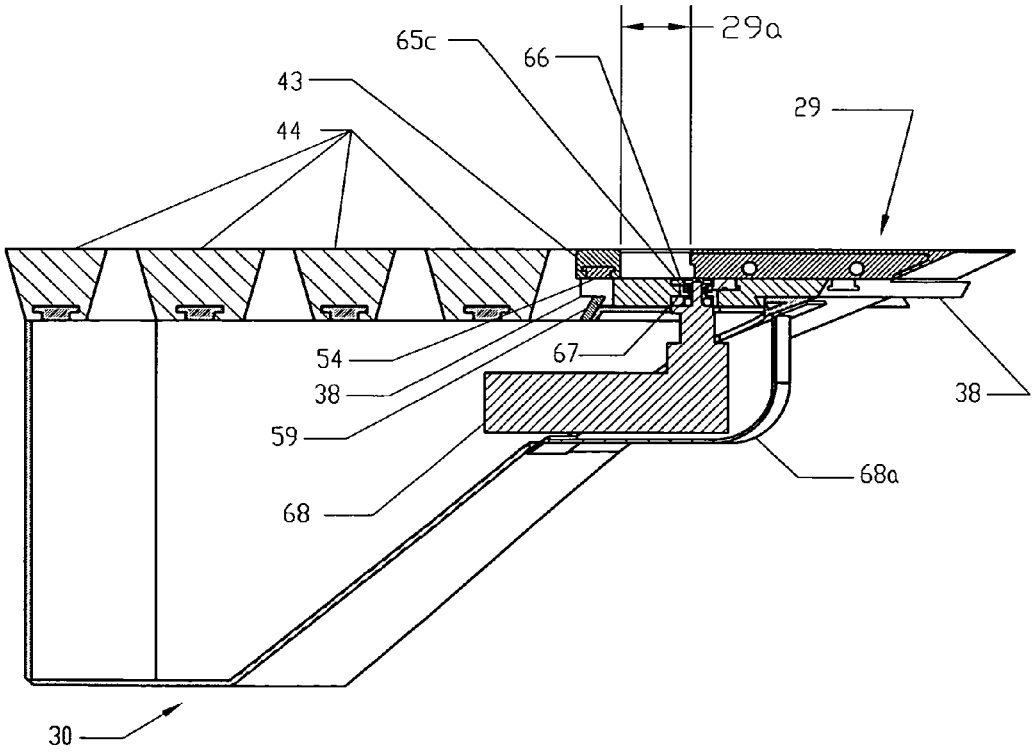

FIG. 10*a* is a sectional view taken along the line 10*a*-10*a* of FIG. 10.

Figure 11A:
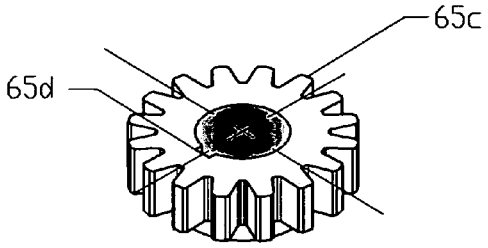
Figure 11:
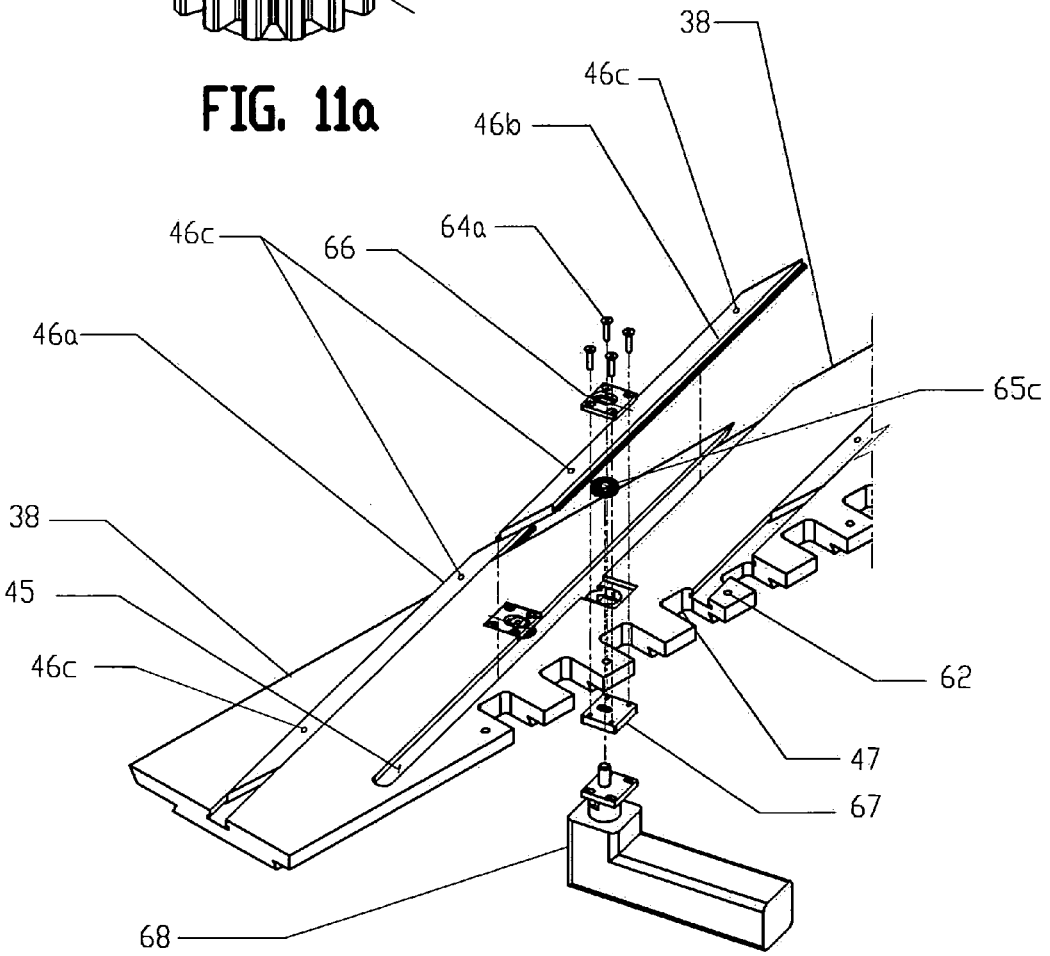

FIG. 11 is an exploded view of a rack and pinion assembly in the slide base with one of the servo gear-motor drives 68 shown.

FIG. 11*a* is a perspective view of the pinion 65*c* with a keyway for fitting to the shaft of the servo gear-motor drive 68.

DRAWINGS

References

21 is the head box.
22 is the paper slurry.
23 is the jet of slurry out of the slice opening.
24 is the top slice lip.
25 is the bottom slice lip.
26 is the wire.
27 is the breast roll.
27*a* is a wire return roll.
28 is the downward jet of slurry that splits ahead of the lead blade.
29 is the lead blade of the forming board.
29*a* is the gap between the lead blade and the follower blade.
29*b* is a ceramic cover.
29*c* is a groove in the lead blade on the downstream side.
30 is the forming board drainage box.
31 is the arrow indicating the downward direction of flow of the split jet of slurry.
32 is the arrow indicating the direction and point of impingement of the jet 23 to the lead blade.
33 is an arrow indicating the horizontal flow of the slurry on the wire.
33*a* is an arrow indicating the movement of the lead blade toward the headbox.
33*b* is an arrow indicating the movement of the Lead Blade away from the head box.
33*c* is an arrow indicating the movement of the lead blade along the grooves in the slide base toward the center of the Fourdrinier.
33*d* is an arrow indicating the movement of the lead blade along the grooves in the slide base away from the center of the Fourdrinier.
34 is an arrow indicating the direction of water flow draining through the wire.
35 is a gravity drainage box.
36 is a jack screw actuator.
36*a* is the jack screw of the actuator.
37 is the Fourdrinier Table.
38 is the slide base.
38*a* is the flushing hole drilled through the length of the slide base.
38*b* are a plurality of flushing holes in grooves of slide base.
39 is the jack screw hand wheel.
40 is the lead blade Scale.
41 is the lead blade Pointer.
42 is the lead blade connector block.
42*a* is the lead blade connector block pin.
43 is the follower blade.
44 is a forming board trail blade.
45 is a plurality of grooves in the slide base.
46 is a plurality of guide bars on the bottom of the lead blade.
46*a* is a plurality of guide bars with gear teeth for a rack and pinion.
46*b* are the guide bar fasteners.

46*c* are the holes for the guide bar fasteners.
46*d* are grooves cut in the bottom of the lead blade guide bars.
47 is a plurality of drain holes in the slide base.
48 is a jack screw stop collar.
49 is the jack screw support structure.
50 is the jack screw stop Disk.
50*a* is the stop disk T-handle pin.
51 is a tension rod.
51*a* are the tension rod holes in the lead blade.
52 are lead blade connector pin sleeves.
52*a* are lead blade connector pin fasteners.
52*b* are a plurality of holes in the end of the lead blade.
53 is the connector pin clamp plate.
54 is the follower blade T-bar.
55 is the jack screw rod end eye connector.
56 is the rod end eye ball bushing.
57 is the tension rod clamp plate.
58 is an arrow indicating the cross machine direction.
59 is a dovetail clamp plate.
59*a* is the slide base Dovetail.
60 is the roller shaft.
61 is roller block assembly.
62 is a plurality of threaded holes in Slide Base to attach follower Blade T-bar.
62*a* are the plurality of fasteners that hold the T-bar 54 on the slide base 38.
63 is the threaded hole in the roller shaft.
64 is the roller retaining bolt.
64*a* are the roller block retaining bolts.
65 is the roller with bearing.
65*a* is the roller bearing.
65*b* is the gear tooth pinion with a bearing.
65*c* is the gear tooth pinion keyed for a shaft.
65*d* is the keyway in the gear tooth pinion.
66 is the top clamp plate.
66*a* is a slotted hole.
67 is the bottom clamp plate.
67*a* is a slotted hole.
68 is a servo gear-motor drive with keyed shaft.
68*a* are the servo gear-motor covers.

DETAILED DESCRIPTION

First Embodiment—FIGS. 1, 2, 3, 3*a*, 4, 5, 5*a*, 6, & 6*a*

Figure 1:
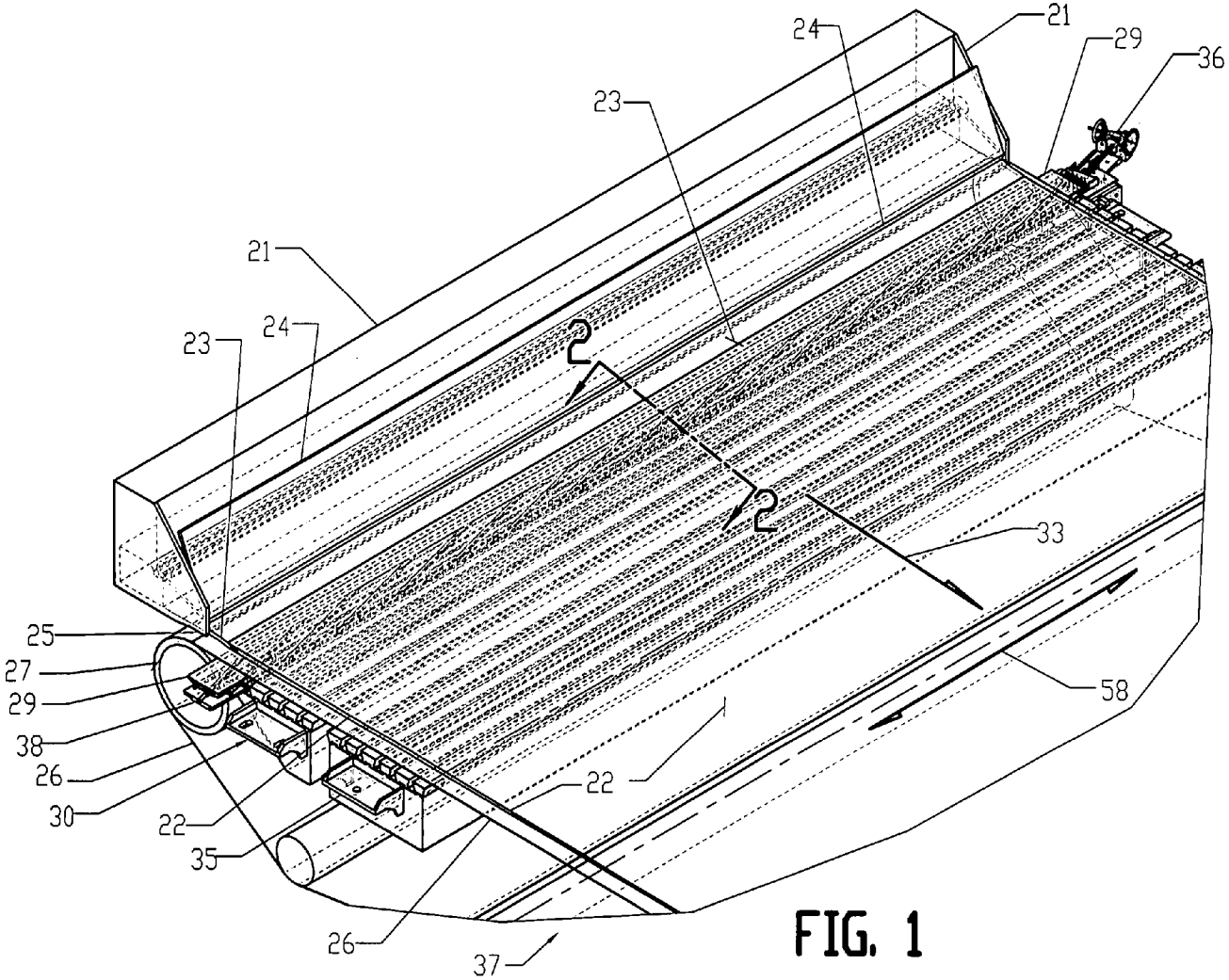
FIG. 1 is a perspective view of the wet end of the Fourdrinier showing the headbox, forming board, and the next drainage element downstream of the forming board.

FIG. 1 illustrates a typical Fourdrinier at the wet end including the headbox 21 and the first two drainage boxes, the forming board 30 and the next gravity drainage box 35. Just below the Headbox 21 is the breast roll 27 and a wire return roll 27*a* for which the wire 26 extends over and around the breast roll 27 and continues down the Fourdrinier 37 in the direction 33. The wire 26 is supported by drainage elements, two of which are shown in FIG. 1, the forming board 30 and the first gravity box 35. Under ideal conditions the slurry 22 inside the headbox 21 forms a jet 23 which emerges out of the slice opening of the headbox 21 and impinges directly on the wire 26 and in the proper position for which the leading edge of the lead blade 29 of the forming board 30 will split the flow of the slurry 22 into two flows. The majority of this flow of slurry 22 will stay in a horizontal direction 33 to be drained of water down the length of the Fourdrinier 37 and a minor flow of slurry 22 will be directed downward at the leading edge of the lead blade 29. Also illustrated in FIG. 1 is the jack screw actuator 36 that moves the lead blade 29 at the discretion of the operator to position the leading edge of the lead blade 29 in the proper position for the jet 23 impingement on the wire 26. The lead blade 29 moves in a plurality of groove in the slide base 38 which is fixed to the forming board 30. The headbox 30 is the embodiment of the top slice lip 24 and the bottom slice lip 25. In typical headbox configurations the top slice lip 24 can move vertically or horizontally to create a slice opening out of the headbox 21 across the width (direction 58) of the Fourdrinier 37 for which the jet 23 emerges. Direction 58 is known as the cross machine direction and which is right angle to the direction the wire 36 is moving.

Figure 2:
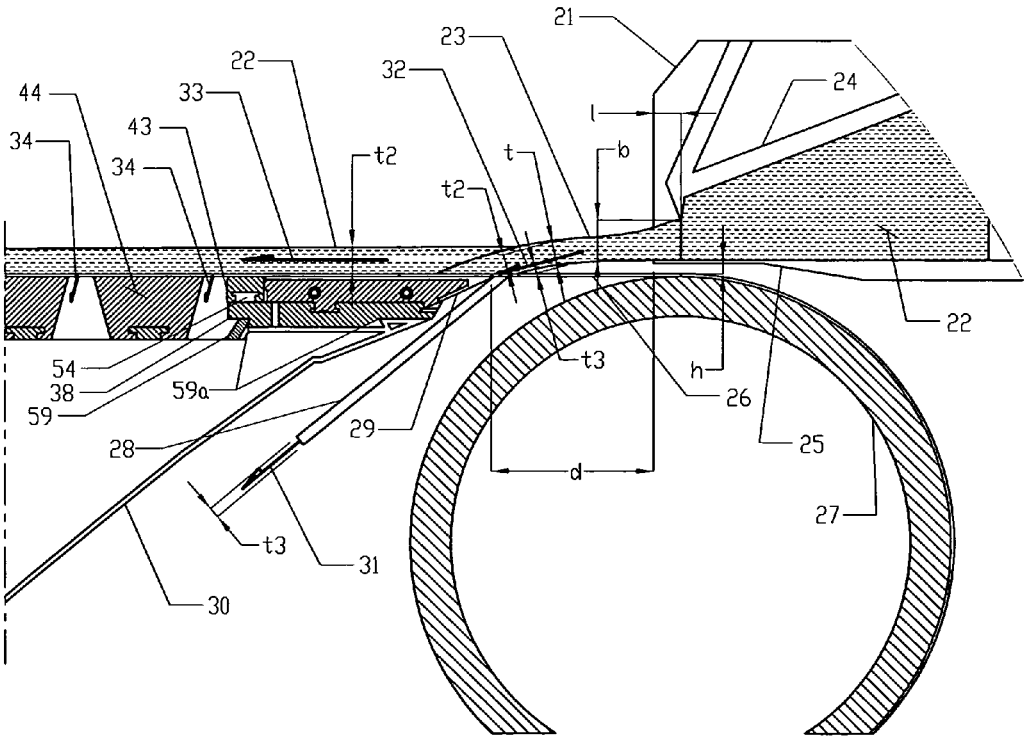
FIG. 2 is a fragmentary sectional view taken along the line 2-2 of FIG. 1.

FIG. 2 illustrates important machine and jet parameters associated with the jet 23 trajectory. This is in the area just downstream of the headbox 21 and the breast roll 27 and for which the wire 26 is supported by the forming board 30. The parameters are defined as follows:

a. b=slice opening
b. t=jet thickness at the vena contracta
c. t2=thickness of the slurry 2 above the wire 6 moving horizontally in direction 13
d. t3=the thickness of the slurry 2 that is directed down in the direction 11 and is split at the leading edge of the lead blade 9
e. d=the distance from the leading edge of the lead blade 9 to the edge of the bottom slice lip 5
f. h=the height of the top surface of the bottom slice lip 5 to the top surface of the wire 6
g. I=the bottom slice lip 5 extension beyond the top slice lip 4 edge An explanation of the physics used to analyze the jet 23 trajectory is given in various textbooks. One such reference is The Institute of Paper Chemistry (IPC) technical paper series number 206 "Fourdrinier Jet Geometry" by Douglas Wahren, November 1986. This paper is specific to the paper industry while keeping with the physics principles of science.

The jet 23 emerges from the slice opening of the headbox 21 at a velocity which is a function of the opening "b" and the total pressure head inside the headbox 21. This total pressure head is the sum of the static and velocity head of the flow of the slurry 22. This opening is set with the movement of the top slice lip 24 with respect to the bottom slice lip 25. The bottom slice lip 25 is permanently fixed to the headbox 21 at the elevation "h" above the wire 26. FIG. 2 shows the bottom slice lip 25 in a horizontal position however it can be tilted at a different angle with the tilting of the headbox 21.

The jet 23 contracts to a minimum thickness "t" at the vena contracta approximately a distance "b" downstream of the edge of the top slice lip 24. The amount of this contraction is a function of the headbox 21 bottom slice lip 25 tilt angle (shown horizontal in FIG. 2) stock properties of the slurry 22, and I/b ratio. Under ideal conditions as shown in FIG. 2, the jet 23 is split into two components, one, a downward slurry, jet 28, in the direction of 11 ahead of the lead blade 29 and the remaining slurry 22 following the horizontal direction 33 along the wire 26 at approximately the same velocity of the wire 26. This split should be in the range of 5% to 10%. The velocity of the jet 23 points in a downward direction 32 and is the point at which the jet 23 impinges at the leading edge of lead blade 29. The velocity of the jet 23 at the point of impingement in the direction of 32, at a distance "d" from the end of the bottom slice lip 25, has a horizontal component in the direction of 33 and a vertical component due to the effect of gravity, the tilt angle of the headbox 21 (horizontal as shown in FIG. 2) velocity of the jet 23 emerging from the headbox 21, and the height "h" of the bottom slice lip 25 above the wire 26. The thickness of the Jet 28 "t3" plus the thickness of the horizontal flow of the slurry 22 above the wire 26 "t2" is equal to the thickness of the jet 23 at the vena contracta "t".

FIG. 2 shows the lead blade 29 in the farthest position downstream such that there is no gap between follower blade 43 and the trailing edge of the lead blade 29. If the wire speed or the stock consistency of slurry 22 is to change the position of impingement of the jet 23 will also change. The movement of the lead blade 29 is designed to slide over the slide base 18 to accommodate changes in the impingement point of jet 23 such that the jet 23 will split in the percent required for the best sheet quality of the slurry 22. The slide base 38 is secured in a dovetail structure of the forming board 30 and held in place with a dovetail clamp plate 59 thereby facilitating the movement of the lead blade 29 sliding over the slide base 38. This movement will be more fully realized in the following detailed description when taken with the accompanying drawings.

Additionally as part of the forming board 30, there are trailing blades 44 which doctor off the water that drains through the wire 26 in the direction 34 and which results in increased consistency of the slurry 22 as it moves down the wire 26.

FIG. 3 is fragmentary top view of the forming board 30 at the actuator end. The actuator is usually on the back side of the Fourdrinier however can be mounted on the front side as well. FIG. 3 shows the lead blade 29 in the retracted position such that there is no gap between the lead blade 29 and the follower blade 43. The jack screw actuator 36 is a worm gear driven jacking screw with anti-backlash characteristics. Typically this actuator assembly would be mounted on the back side of the machine as the wire 26 is replaced from the tending side of the machine. The jack screw actuator 36 is connected to the lead blade 29 through the lead blade connector block 42. When the jack screw actuator 36 is rotated by the jack screw hand wheel 39 in the proper rotation it moves the jack screw 36*a* along the direction 33*c* or at angle "x" from the cross machine direction 58 in FIG. 1 and which is parallel to the slide bars 46 attached to the bottom of the lead blade 29. This action forces movement of the lead blade 29 away from the headbox 21 in the direction of 33*b*. This is because the guide bars 46 are mated with the grooves 45 in the slide base 38 which is fixed to the forming board 30. The movement of the lead blade 29 in the direction of 33*c* is a trigonometric function of the angle "x" to accomplish the desired movement in the direction 33*b* and is the reason the lead blade 29 and the slide base 38 must be wider than the Fourdrinier Table 37. The guide bars 46 and grooves 45 are spaced across the full length of the machine as shown in FIGS. 3 and 3*a* by the hidden lines of the lead blade 29. In this way the lead blade 29 is supported across the full width of the machine and will slide uniformly across the full width of the machine by pulling or pushing on one end of the lead blade 29 with the jack screw actuator 36.

It follows that the smaller angle "x" in FIG. 3, the farther the lead blade 29 has to move in the direction of 33*c* for a given distance in the 33*a* direction resulting in a longer lead blade 29. It also follows that the smaller angle "x" in FIG. 3 the lower the force is at the jack screw actuator 36. There are always practical limits to the length of the lead blade 29 and the angle "x" in FIG. 3 can be optimized for the loading verses the movement providing for optimal length of the lead blade 29.

The lead blade pointer 41 is fixed to the lead blade connector block 42 and moves over the lead blade scale 40 which is fixed on the jack screw support structure 49 and indicates the position of the lead blade 29 with respect to the distance from the bottom slice lip 25 or the distance "d" in FIG. 2.

The jack screw stop collar 40 is fixed to the jack screw 36*a* and prevents the jack screw actuator 36 from damaging the follower blade 43. The jack screw hand wheel 39 can be replaced with a remotely controlled electric motor. Once the lead blade 29 has been set in position the jack screw stop disk 50 can be pinned in place with the stop disk T-handle pin 50*a* to hold the position of the lead blade 29.

FIG. 3*a* is fragmentary top view of the forming board 30 at the actuator end showing the lead blade 29 in the extended position such that there is a gap 29*a* between the lead blade 29 and the follower blade 43. The jack screw actuator 36 which is connected to the lead blade 29 through the lead blade connector block 42 moves the lead blade 29 in the same way as described in FIG. 3 only in the opposite direction along the direction 33*d* or at angle "x" from the cross machine direction 58 in FIG. 1 and which is parallel to the slide bars 46 attached to the bottom of the lead blade 29. The action of the jack screw actuator 36 subsequently forces movement of the lead blade 29 toward the headbox 21 in the direction of 33*a*. The movement of the lead blade 29 is forced to slide along the grooves 45 in the slide base 38 because the guide bars 46, being attached to or a part of the bottom of the lead blade 29, mate to the grooves 45 and are at the same angle "x" to the guide bars 46.

FIG. 4 is a perspective view of the forming board 30 at the actuator end showing the lead blade 29 in the retracted position of FIG. 3.

FIG. 5 is an exploded view of the forming board assembly as shown in FIG. 4. This view more clearly shows the mechanical linkage between the jack screw actuator 36 and the lead blade 29. It may for example consist of a threaded connection between the jack actuator screw 36*a* and the jack screw rod end eye connector 55 that houses a rod end ball bushing 56 and pinned with a lead blade connector block pin 42*a* to the lead blade connector block 42. The installation of the ball bushing 56 provides for a universal joint to eliminate the binding forces for misalignment of the jack screw assembly. This assembly is apparent to those skilled in the art.

FIG. 5 also shows a means by which the lead blade 29 is secured to the lead blade connector block 42 by a plurality of lead blade connector sleeves 52 that fit in the mating holes 52*b* in the end of the lead blade 29. The connector sleeves 52 are held in place with the lead blade connector pin fasteners 52*a* in conjunction with the lead blade connector pin clamp plate 53. The lead blade connector pin clamp plate 53 allows for the heads of the lead blade connector pin fasteners 52*a* to be tack welded in place to prevent the fasteners from coming lose during operation of the paper-making process. Another means of fastening the lead blade connector block 42 to the lead blade 29 is through the use of a plurality of tension rods 51 that are installed through channels in the lead blade 9 and connected with a threaded journal to the lead blade connector block 42. The tension rods 51 serve to help transfer the end load from the jack screw actuator 36 to the total length of the lead blade 29 such that stress is reduced to the ceramic material that is a part of the materials of construction of the lead blade 29.

Another illustration in FIG. 5 is the assembly of the jack screw stop disk 50 that is keyed to the shaft of the jack screw actuator 36 and provides for a means by which the jack screw actuator 36 can be locked in place after final positioning. This is done by installing the stop disk T-handle pin 50*a* in a hole of the jack screw stop disk 50 and aligned most closely with a fix hole in the jack screw support structure 49. Upon removal of the stop disk T-handle pin 50*a* the jack screw actuator 36 can be free for rotation with the jack screw hand wheel 39.

FIG. 5*a* is a sectional view of the lead blade taken along the line 5*a*-5*a* of FIG. 5. This view shows the channels or tension rod holes 51*a* that the tension rods 51 are installed through for the full length of the lead blade 29. Also illustrated is the ceramic cover 29*b* that the lead blade 29 is a composite of. The shape of the lead blade 29 including the angle "Y", shown in FIG. 5*a*, is an important parameter for determining what the split of the jet 23 ratio "t3/t2" should be.

The bottom of the guide bars 46 have a small groove 46*d* cut to allow for flushing water to keep the grooves 45 in the slide base 38 clean and lubricated for reduced friction with the guide bars 46.

The downstream edge of the lead blade 9 has a groove 29*c* the full length of lead blade 29. This groove serves to provide a relief for stock build-up between the lead blade 29 and the follower blade 43 when the lead blade 29 is in the retracted position such that the gap 29*a* in FIG. 3*a* is zero distance.

FIG. 6 is an exploded view of the forming board at the non-actuator end or on the tending side of the Fourdrinier and illustrates more fully how the tension rods 51 are clamped on the end of the lead blade 29 with the tension rod clamp plate 57. The tension of the tension rods 51 can be adjusted with a threaded nut on the end of the tension rod 51 against the clamp plate 57.

Also shown is the follower blade 43 that slides on the follower blade T-bar 54. The T-bar 54 is fixed to the slide base 38 with a plurality of threaded fasteners 62*a* that match the threaded holes 62 in the slide base 38 shown in FIG. 7.

FIG. 6*a* illustrates an alternative detachment of the guide bars 46 that are attached to the bottom of the lead blade 29 at angle "x" shown in FIG. 3 such that the guide bars can be made of a metal or dissimilar material from the composite material of the lead blade 29 and can be assembled on the bottom of the lead blade 29 with guide bar fasteners 46*b* through holes 46*c*. This will provide for reduced coefficient of friction between the sliding parts of the guide bars 46 attached to the lead blade 29 and the grooves 45 in the slide base 38 with the resultant reduction in load on the jack screw actuator 36.

Operation

First Embodiment—FIGS. 1, 2, 3, 3*a*, 4, 5, 5*a*, 6, & 6*a*

The operation of positioning the lead blade 29 of the forming board 30 to the headbox 21 a distance "d" from the bottom slice 25 to the lead blade 29 shown in FIG. 2 is done without having to move the whole embodiment of the forming board 30. Only the lead blade 29 is moved. This is simply done by the jack screw actuator 36 from one end (usually the back side). The jack screw actuator 36 moves the lead blade 29 along the direction of 33*c*, which is at angle "x" shown in FIG. 3 or the opposite direction of 33*d* shown in FIG. 3*a*, depending on the direction of rotation of the hand wheel 39. The guide bars 46 attached to the bottom of the lead blade 29 are embedded in the grooves 45 of the slide base 38 which is fixed to the forming board 30. The movement of the lead blade 29 along the grooves 45 in the slide base 38 results in the movement of the lead blade 29 toward the headbox 21 to attain the distance "d" and is indicated with the pointer 41 on the scale 40 shown in FIG. 3*a*. As the distance "d" in FIG. 2 decreases the gap 29*a* in FIG. 3*a* increases which provide for an opening between the lead blade 29 and the follower blade 43. The gap 29*a* will allow water to drain through the holes 47 in the slide base 38. The size and shape of these holes are significant for controlling the amount of water that drains through the wire 26. Additionally the shape of the follower blade 43 can have ramifications on how much water is drained and how much activity the blade may impart into the slurry 22. The follower blade 43 is stationary and will maintain the blade spacing from that point downstream such that the harmonics of the system is not affected.

After the lead blade 29 is set in position it can be locked in place with the stop disk 50 and pinned in place with the stop disk pin 50*a* shown in FIG. 3*a*. This will lock the jack screw 36 in place which will hold the lead blade 29 in the set position.

DETAILED DESCRIPTION

Second Embodiment—FIGS. 7, 7*a*, 8, 9, 9*a*, & 9*b*

FIG. 7 is a fragmentary plan view of the slide base 38 showing the addition of roller block assemblies 61 mounted in pairs, adjacent to and on each side of selected grooves of the slide base 38. There may be two or more pairs of roller block assemblies 61 equally spaced along the full length of the slide base 38. This is an improvement over the first embodiment in that the rollers assemblies 61 will reduce the frictional forces between the guide bars 46 and the grooves 45.

Also shown in FIG. 7 are flushing holes 38*a* and 38*b* which provide a channel in the slide base 38 for the addition of flushing water to clean the grooves 45 of any stock build-up from the drainage of the slurry 22. This flushing water can be connected to the flushing hole 38*a* at the end side of the slide base 38 on the tending side. Additionally the flushing water will provide some lubrication of the sliding surfaces between the grooves 45 and the guide bars 46.

Another feature shown in FIG. 7 are the plurality of drain holes 47 that are cut out of the downstream side of the slide base 38 to allow for water drainage between the downstream edge of the lead blade 29 and the follower blade 43. This area is shown as gap 29*a* on FIG. 3*a*. The shape of these cut-outs in the edge of the slide base 38 can be made any size or shape to restrict the drainage of the slurry 22 in this area of the forming board 30.

FIG. 7*a* is an end view of the slide base 38 and most notably shows the shape of the slide base dovetail 59*a* that matches the dovetail shape in the structure of the forming board 30. The dovetail clamp plate 59 shown in FIG. 2 secures the slide base 38 to the forming board 30. The dovetail clamp plate 59 is a long narrow strip of metal that crosses the width of the Fourdrinier and is held in place with a plurality of threaded fasteners clamping the slide base 38 to the structure of the forming board 30.

The flushing hole 38*a* is blind drilled in the end of the slide base 38 from the tending side to a point at the actuator end of the slide base 38 such that flushing water can enter the last of the grooves 45 through one of the flushing holes 38*b*. The flushing water subsequently can enter the groove 46*d* in the guide bars 46 as shown in FIGS. 5*a* and 8. The flushing holes and channels provide flushing water to all parts of the system when required.

FIG. 8 is a sectional view that illustrates the details of the roller block assembly 61. The roller 65 is fitted with a plain bearing to allow rotation on the roller shaft 60 and positioned to contact the edge of the guide bar 46 providing a rolling surface for the guide bar 46 to move on. The roller block assembly 61 is installed in pairs on each side of the grooves 46 to provide a rolling surface for movement of the guide bars 46 in either direction 33*c* in FIG. 3 or 33*d* in FIG. 3*a*. The roller shaft 60 has a threaded hole 63 to provide for the roller retaining bolt 64 which holds the roller 65 in place. The top clamp late 66 and the bottom clamp plate 67 are secured to the slide base 38 in recessed holes adjacent to a groove 45. The assembly of the parts is more fully realized in the following detailed description when taken with the accompanying drawings.

The fit between the guide bars 46 and the grooves 45 is best illustrated in FIG. 8. This fit can have the shape of a T-bar as shown in the figures of these embodiments or it can have other shapes such as a dovetail 59*a* as shown for the fit between the slide base 38 and the forming board 30 structure in FIG. 2. The fit between the guide bars 46 and the grooves 45 in the slide base 38 must provide the proper clearance to allow thermal expansion such that the sliding action of the guide bars in the grooves is not impeded for the temperatures of operation of the papermaking process.

FIG. 9 is an exploded view of the roller block assembly 61 as shown in FIG. 8. Illustrated is how the roller block assembly 61 is fastened to the slide base 38 with the roller block retaining bolts 44*a*. Also shown more explicitly is the slotted hole 66*a* in the top clamp plate 66 and the slotted hole 67*a* in the bottom clamp plate 67 and which allow for adjustment of the position of the roller 65 for contact against the edge of guide bar 46. An alternative method of adjustment for the roller 65 is to have the roller mounted on an eccentric sleeve much as done in the industry for cam followers and is apparent to an expert in the field.

FIGS. 9*a*, 9*b* and 9*c* illustrate another embodiment of the roller block assembly 61 such that the roller 65 is replaced with a gear 65*b* and which has a plain bearing 65*a*. Additionally, the guide bars 46 is replaced with a guide bars 46*a* that have mating gear teeth to gear 65*b* and provide for a rack and pinion assembly that keeps the gear rotating with movement of the lead blade 29. The improvement of this assembly over the assembly described in FIG. 8 is that the bearings will always rotate and never seize up. Also the rack and pinion design sets the stage for moving the lead in an alternative way which will become more fully realized in the following detailed description when taken with the accompanying drawings.

DETAILED DESCRIPTION

Third Embodiment—FIGS. 10, 10*a*, 11, & 11*a*

FIGS. 10, 10*a*, 11, & 11*a* is an alternative embodiment for moving the lead blade 29 such that the jack screw actuator 36 is no longer needed on the back side of the Fourdrinier to move the lead blade 29. This is illustrated in FIG. 10. The jack screw actuator 36 is replaced with a plurality of servo gear-motor drives 68 shown in the hidden lines in FIG. 10.

FIG. 10*a* is a sectional view that shows one of the servo gear-motor drives 68 that is keyed to the gear tooth pinion 65*c* and can rotate pinion gear 65*c* such that the guide bar 46*a* with matching gear teeth will move the lead blade 29 in unison with the other servo gear-motor drives 68 to the desired position as shown in FIG. 2. These servo gear-motor drives 68 can be a right angle gearbox arrangement to keep the profile of the gear-motor as small as possible and to allow for a cover 68*a* to protect the servo gear-motor 68 from fluid flow of the slurry 22 drainage through the wire 26. Alternatively the cover can be made to hermetically seal the servo gear-motor off from the fluid flow of the drainage from the slurry 22. The control of these servo gear-motor drives 68 can be a simple load sharing drive that will work in unison to move the lead blade 29. The torque loading requirement of these servo gear-motor drives 68 is dependent on the angle "x" in FIG. 10 and the number of drives installed.

FIGS. 11 and 11*a* shows more clearly how the servo gear-motor drive 68 is keyed to the gear tooth pinion 65*c* with the slot 65*d*. The pinion 65*c* meshes with the gear teeth of 46*a* which are connected to the bottom of the lead blade 29 similar to the guide bars 46 shown in FIG. 6*a*.

One of the major advantages to the third embodiment with the servo gear-motor drives is that if properly sized the angle "x" can be greater than 45 degrees to as high as 90 degrees eliminating the need for a lead blade 29 that is wider than the forming board 30.

Operation

Third Embodiment—FIGS. 10, 10*a*, 11, & 11*a*

The operation of positioning the lead blade 29 of the forming board 30 to the headbox 21*a* distance "d" from the bottom slice 25 to the lead blade 29 shown in FIG. 2 is done remotely with the use of the servo gear-motors 68 in the third embodiment of the invention. FIG. 11 shows the connection to the lead blade 29 such that when the servo gear-motor 68 provides torque to rotate the pinion gear 65*c* that force is transmitted to the gear teeth of the guide bars 46*a* which in turn moves the lead blade 29 linearly in the slide base 38.

CONCLUSIONS, RAMIFICATIONS, AND SCOPE

Accordingly the reader will see that, the embodiments of the invention, has provided a means to position the lead blade 29 of the forming board 30 such that the emerging jet from the headbox 21 impinges at the proper position on the lead blade 29 to provide for improved sheet quality and limit air entrapment in the slurry 22 as the slurry 22 continues to drain along the length of the Fourdrinier. This invention focuses on moving the lead blade 29 only and not moving the forming board 30 with to all of the trailing blades 44 which will require more expensive hardware such as cross shafts with large gearboxes. Additionally, by not moving the whole forming board 30 the risk of upsetting the harmonics of the sheet formation on the Fourdrinier is reduced. This is because the distance between the forming board trailing blades 29 to the other drainage elements downstream does not change.

The first embodiment of this invention as shown in FIGS. 1, 2, 3, 3*a*, 4, 5, 5*a*, 6, & 6*a* has a unique feature in that it is easily retro-fit able to most forming boards because of the dovetail 59 design as shown in FIG. 7*a*. All that is required is to build a slide base 38 that matches the fit to the dovetail of a standard lead blade of most forming boards. Additionally the slide base 38 can be fixed to the forming board 30 by any type of fastening system that is different than the standard dovetail system commonly used in the art.

The second embodiment of this invention as shown in FIGS. 7, 7*a*, 8, 9, 9*a*, 9*b*, & 9*a* is an improvement of the first embodiment by reducing the forces of the jack screw actuator 36 for moving the lead blade 29 back and forth in the plurality of grooves 45 of the slide base 38. This is done with roller bearings to reduce the friction load from the sliding action of the guide bars 46 and the grooves 45 and flushing holes which help keep the grooves 45 clean.

The third embodiment of this invention as shown in FIGS. 10, 10*a*, 11, & 11*a* requires the re-work of an existing forming board or the manufacture of a new forming board to allow the installation of the plurality of servo gear motor drives 68 to move the lead blade 29 in the same way as the first embodiment. While the third embodiment is more expensive than the first embodiment the third embodiment has the advantage of distributing the forces of movement of the lead blade 29 along the full length of the blade eliminating the need for the tension rod 51. This is because when the force of movement is applied at one end as shown in the first embodiment the tension rods 51 transfer the load to the end of the lead blade 29 when actuated by the jack screw actuator 36 from one end. Another advantage of the third embodiment is that the angle "x" shown in FIG. 10 can be greater than 45 degrees and as high as 90 degrees eliminating the need for a longer lead blade 29 that is wider than the forming board 30. The first embodiment is limited to an angle "x" to less than 45 degrees because the forces required for moving the lead blade 29 would be too great at the jack screw actuator 36.

While the above description contains many specifics, these should not be construed as limitations on the scope of any embodiment, but as exemplifications of various embodiments thereof. Many other ramifications and variations are possible within the teachings of the various embodiments. For example, the shape of the drainage holes 47 shown in FIG. 7 can be made circular or triangular to regulate the rate of flow of water through this area as the gap 29*a* shown in FIG. 3*a* increases with the movement of the lead blade 29 toward the headbox 21. Another ramification is that the jack screw 36 can be driven by an electric motor and the scale 40 and pointer 41 can be replaced by a linear indicator to provide feedback to the electric motor to allow for remote control of the position of the lead blade 29. Additionally the electric motor can be fit with an integral brake to maintain the position of the lead blade 29. Thus the scope should be determined by the appended claims and their legal equivalents, and not by the examples given.

The invention claimed is:

1. An apparatus for moving a lead blade only of a forming board box on a fourdrinier paper machine having a headbox for impinging a jet of slurry from a slice opening of the headbox onto a surface of a porous forming fabric moving continuously in a horizontal machine direction over the forming board, the apparatus comprising:

a) a lead blade having multiple guide bars formed on a bottom of the lead blade at an oblique angle "X" to the cross machine direction wherein guide bars are spaced along the full length of the lead blade to ensure the leading edge of the said blade stays parallel to the apron of the headbox throughout an adjustment range;

b) a slide base with multiple grooves that match guide grooves formed on the bottom of lead blade;

c) means for adjustment of the lead blade only while leaving the rest of the forming board drainage elements stationary accomplished by either a manual or automatic device attached to either end of the lead blade to move the lead blade to position to achieve the best formation and sheet structure for optimizing a jet landing while not altering the proper spacing on the remaining drainage elements in the forming board box enabling maintaining proper harmonics in the critical initial forming zone of the fourdrinier.

2. The apparatus of claim 1 wherein said plurality of guide bars formed on the bottom of said lead blade having detachable means whereby said guide bars are replaceable due to frictional wear resulting from frictional loading between the guide bars and grooves in the slide base when moving the lead blade.

3. The apparatus of claim 1 wherein said device providing urging means to said lead blade comprising of an actuator that transfers rotational movement to linear movement to move said lead blade wherein rotational means of said actuator is provided manually by an operator or provided remotely with an electric motor wherein said urging means is provided with an integral stop disk or brake wherein the position of the lead blade is maintained.

4. The apparatus of claim 1 wherein the slide base has a plurality of drain holes that are cut out of the downstream side of the slide base for water drain between the downstream edge of the lead blade and the stationary follower blade as the lead blade moves toward the head box to ensure clean operation.

* * * * *